US011849808B2

(12) United States Patent
Archuleta

(10) Patent No.: US 11,849,808 B2
(45) Date of Patent: Dec. 26, 2023

(54) ORTHOTIC SUPPORT ASSEMBLY

(71) Applicant: Patricia Archuleta, Conejos, CO (US)

(72) Inventor: Patricia Archuleta, Conejos, CO (US)

( * ) Notice: Subject to any disclaimer, the term of this patent is extended or adjusted under 35 U.S.C. 154(b) by 155 days.

(21) Appl. No.: 17/710,039

(22) Filed: Mar. 31, 2022

(65) Prior Publication Data

US 2023/0309647 A1 Oct. 5, 2023

(51) Int. Cl.

| | |
|---|---|
| ***A43C 19/00*** | (2006.01) |
| ***A43B 7/143*** | (2022.01) |
| ***A43B 7/1405*** | (2022.01) |
| ***A43B 13/18*** | (2006.01) |
| ***A43B 3/24*** | (2006.01) |

(52) U.S. Cl.

CPC ..... *A43B 7/143* (2013.01); *A43B 3/24* (2013.01); *A43B 7/141* (2013.01); *A43B 13/186* (2013.01); *A43C 19/00* (2013.01)

(58) Field of Classification Search

CPC .. A43B 7/14; A43B 7/143; A43B 7/24; A43B 3/24; A43B 3/246; A43C 19/00

USPC ..... 36/136

See application file for complete search history.

(56) References Cited

U.S. PATENT DOCUMENTS

| | | | | |
|---|---|---|---|---|
| 250,108 | A * | 11/1881 | Stewart | A43C 19/00 36/7.8 |
| 2,435,976 | A | 2/1948 | Monagin | |
| 4,458,430 | A | 7/1984 | Peterson | |
| 4,738,262 | A | 4/1988 | Zebrack | |
| 5,345,701 | A * | 9/1994 | Smith | A43B 7/24 36/144 |
| 5,727,335 | A | 3/1998 | Kousaka | |
| 6,474,006 | B1 * | 11/2002 | Cummings | A43B 7/24 36/144 |
| 6,739,075 | B2 | 5/2004 | Sizemore | |
| 8,241,232 | B2 * | 8/2012 | Sanders | A61H 15/00 601/115 |
| D677,456 | S | 3/2013 | Knight | |
| 9,756,897 | B1 * | 9/2017 | Millis | A63C 3/00 |
| 2013/0239440 | A1 * | 9/2013 | Santos | A63B 21/4015 36/136 |
| 2013/0255102 | A1 | 10/2013 | Terrell | |
| 2013/0291407 | A1 * | 11/2013 | Adair | A43B 13/189 36/126 |
| 2015/0173457 | A1 * | 6/2015 | Saito | A43B 13/40 36/44 |
| 2017/0105474 | A1 * | 4/2017 | Morrison | A43B 7/1405 |
| 2018/0242687 | A1 * | 8/2018 | Granger | A43B 7/143 |
| 2019/0053567 | A1 | 2/2019 | Thomas | |
| 2020/0352279 | A1 * | 11/2020 | Morrison | A43C 19/00 |

(Continued)

*Primary Examiner* — Marie D Bays

(57) ABSTRACT

An orthotic support assembly includes a first orthotic support that is attachable to a sole of a shoe to abut a support surface upon which a user is walking. The first orthotic support has a rounded profile thereby facilitating the sole of the shoe to roll on the first orthotic support when the user walks. A second orthotic support is attachable to the sole of the shoe and the second orthotic support has a rectilinear profile to inhibiting the sole of the shoe from rocking on the first orthotic support when the user walks. A third orthotic support is attachable to the sole of the shoe and the third orthotic support has a trapezoidal profile. In this way the sole of the shoe is oriented level on the ground to facilitate a user with an unstable foot to walk in a level orientation.

9 Claims, 4 Drawing Sheets

(56) References Cited

U.S. PATENT DOCUMENTS

| | | | | |
|---|---|---|---|---|
| 2023/0052232 | A1* | 2/2023 | Tominaga | A43B 17/00 |
| 2023/0270199 | A1* | 8/2023 | Jacobs | A43B 13/188 36/25 R |

* cited by examiner

ORTHOTIC SUPPORT ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to orthotic devices and more particularly pertains to a new orthotic device for facilitating ulcers on a user's foot to heal. The device includes a first orthotic support that has a rounded profile which is attachable to a sole of a shoe. The device includes a second orthotic support that has a rectilinear profile which is attachable to the sole of the shoe in lieu of the first orthotic support. The device includes a third orthotic support that has a trapezoidal profile which is attachable to the sole of the shoe in lieu of the first orthotic support and the second orthotic support.

(2) Description of Related Art Including Information Disclosed Under 37 CFR 1.97 and 1.98

The prior art relates to orthotic devices including a shoe with a curved sole. The prior art discloses a shoe with a plurality of shock absorbing pads integrated into a sole of the shoe. The prior art discloses a shoe with an elevated heel and a pair of skates integrated into a toe of a sole of the shoe. The prior art discloses a shoe that has sloped heel to facilitate the sole of the shoe to rock on a support surface while walking. The prior art discloses a shoe that has a plurality of spring loaded shock absorbers each integrated into a sole of the shoe. The prior art discloses a shoe that has a plurality of convex bulges on a sole of the shoe. The prior art discloses an adhesive pad that is positionable on a sole of a shoe which has plurality of undulating elements.

(h) BRIEF SUMMARY OF THE INVENTION

An embodiment of the disclosure meets the needs presented above by generally comprising a first orthotic support that is attachable to a sole of a shoe to abut a support surface upon which a user is walking. The first orthotic support has a rounded profile thereby facilitating the sole of the shoe to roll on the first orthotic support when the user walks. A second orthotic support is attachable to the sole of the shoe and the second orthotic support has a rectilinear profile to inhibiting the sole of the shoe from rocking on the first orthotic support when the user walks. A third orthotic support is attachable to the sole of the shoe and the third orthotic support has a trapezoidal profile. In this way the sole of the shoe is oriented level on the ground to facilitate a user with an unstable foot to walk in a level orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
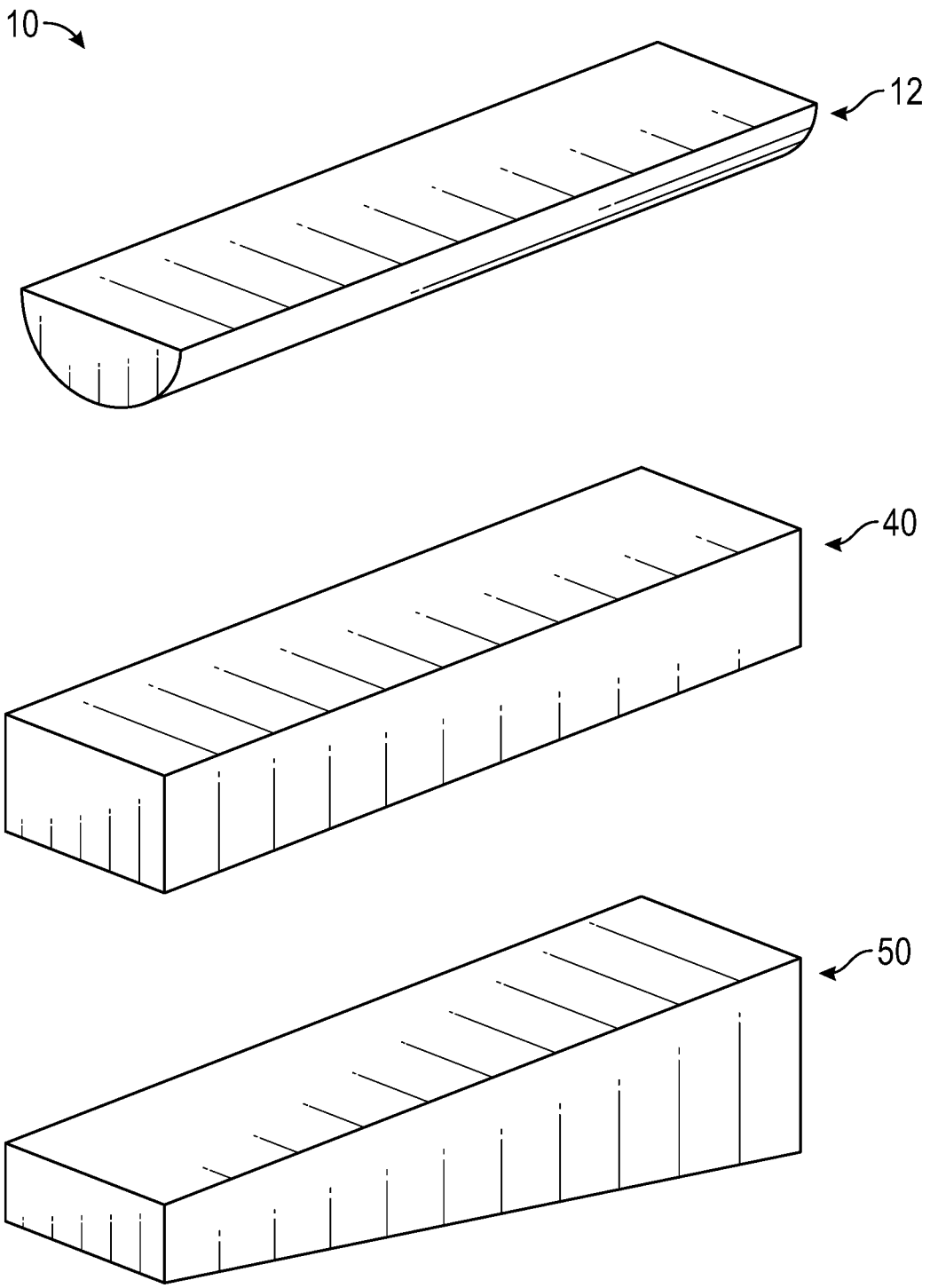
FIG. 1 is a perspective view an orthotic support assembly according to an embodiment of the disclosure.
Figure 2:
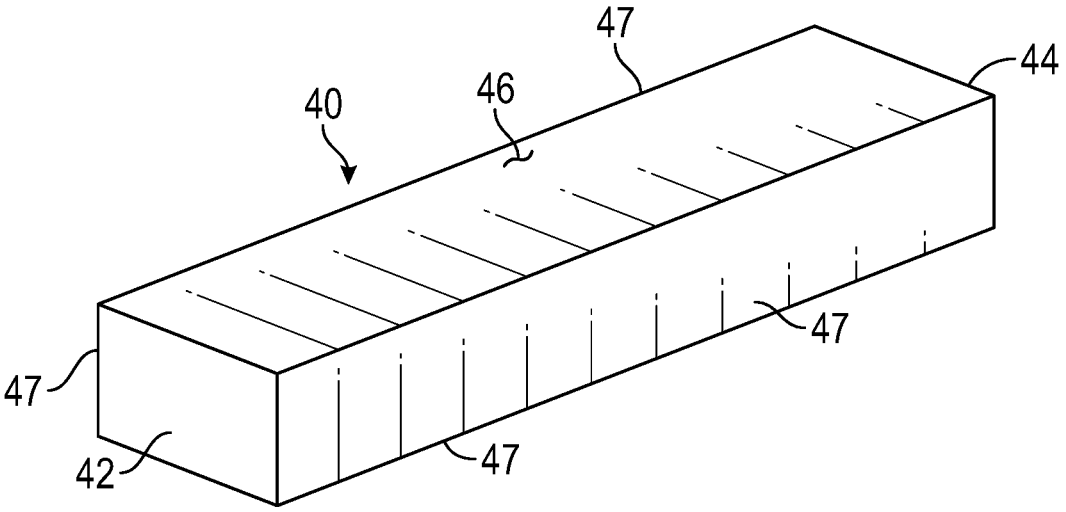
FIG. 2 is a perspective view of a second orthotic support of an embodiment of the disclosure.
Figure 3:
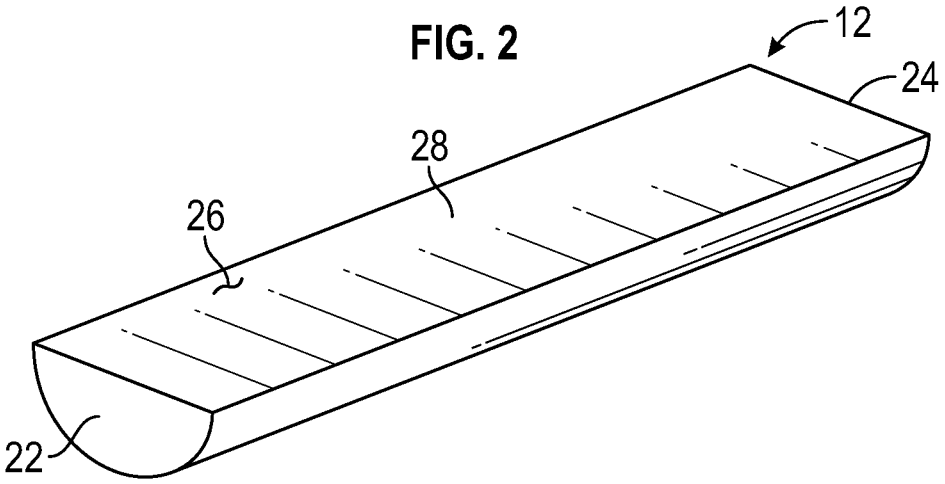
FIG. 3 is a perspective view of a first orthotic support of an embodiment of the disclosure.
Figure 4:
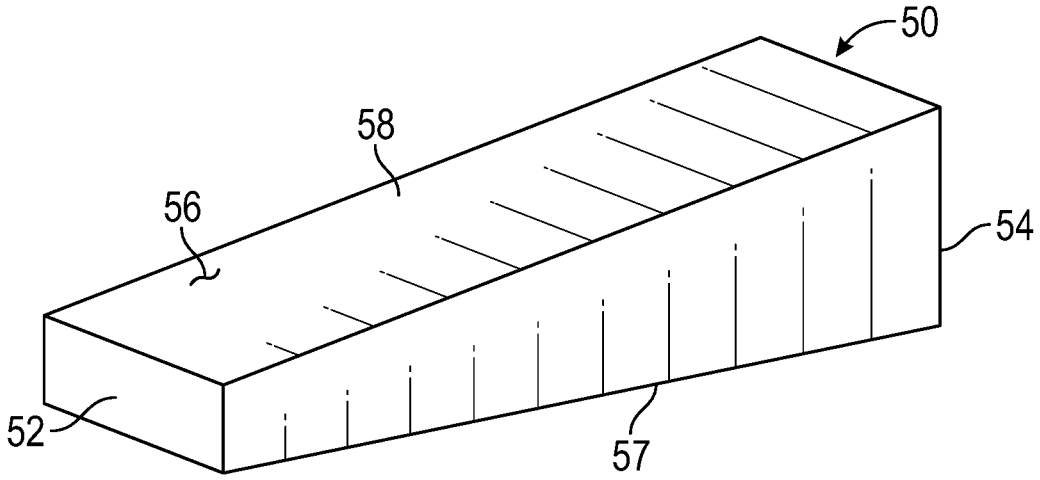
FIG. 4 is a perspective view of a third orthotic support of an embodiment of the disclosure.
Figure 5:
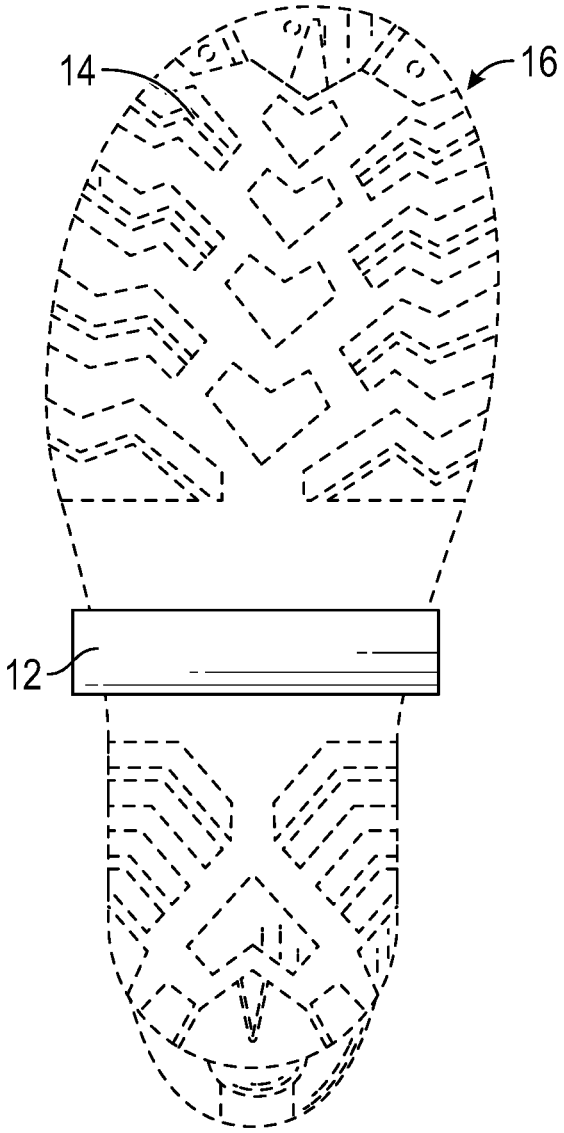
FIG. 5 is a bottom in-use view of a first orthotic support of an embodiment of the disclosure.
Figure 6:
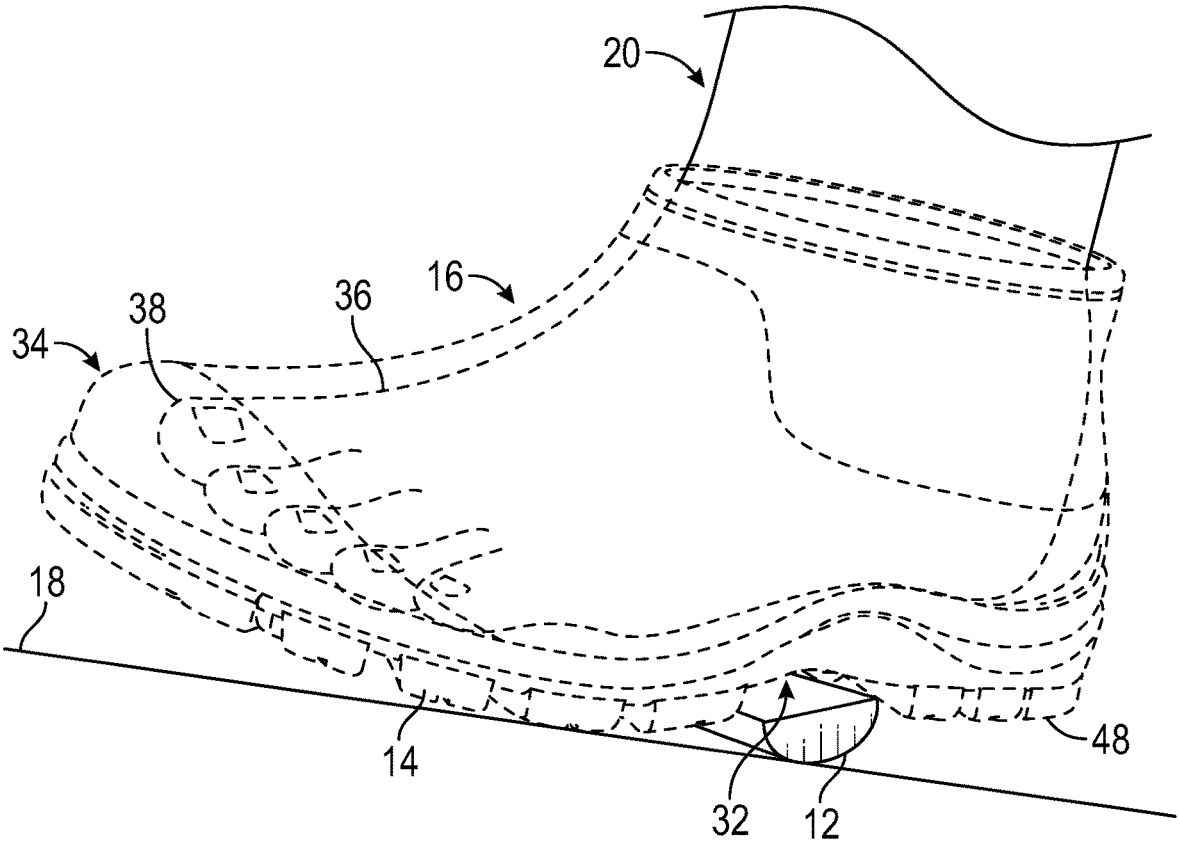
FIG. 6 is a perspective in-use view of a first orthotic support of an embodiment of the disclosure.

With reference now to the drawings, and in particular to FIGS. 1 through 6 thereof, a new orthotic device embodying the principles and concepts of an embodiment of the disclosure and generally designated by the reference numeral 10 will be described.

As best illustrated in FIGS. 1 through 6, the orthotic support assembly 10 generally comprises a first orthotic support 12 that is attachable to a sole 14 of a shoe 16. In this way the first orthotic support 12 abuts a support surface 18 upon which a user 20 is walking. The shoe 16 may be any article of footwear that the user 20 wears on their feet for walking. Additionally, the user 20 may be a user suffering from diabetes or other illness that renders the user 20 prone to developing ulcers on their feet. The first orthotic support 12 has a rounded profile thereby facilitating the sole 14 of the shoe 16 to roll on the first orthotic support 12 when the user 20 walks.

The first orthotic support 12 has a first end 22, a second end 24 and an outer surface 26 extending between the first end 22 and the second end 24, and the first orthotic support 12 is elongated between the first end 22 and the second end 24. The outer surface 26 has a top side 28 and a bottom side 30; the top side 28 is planar and the bottom side 30 is concavely arcuate with respect to the top side 28. The top side 28 is adhered to the sole 14 of the shoe 16 thereby facilitating the bottom side 30 to roll along the support surface 18. The first orthotic support 12 extends laterally across the sole 14 of the shoe 16 having the first orthotic support 12 being aligned with an arch 32 of the sole 14. In this way the first orthotic support 12 can inhibit a toe 34 of the shoe 16 from striking the ground when the user 20 walks thereby reducing pressure on ulcers on the ball of the user's foot 36 and the user' toes 38. Thus, the ulcers are not only facilitated to heal properly, but the ulcers are additionally inhibited from becoming infected.

A second orthotic support 40 is attachable to the sole 14 of the shoe 16 in lieu of the first orthotic support 12. The second orthotic support 40 has a rectilinear profile thereby inhibiting the sole 14 of the shoe 16 from rocking on the first orthotic support 12 when the user 20 walks. The second orthotic support 40 has a first end 42, a second end 44 and an outside surface 46 extending between the first end 42 and the second end 44 of the second orthotic support 40. The second orthotic support 40 is elongated between the first end 42 and the second end 44 of the second orthotic support 40.

The outside surface 46 has a plurality of sides 47 each intersecting a perpendicular angle such that the second orthotic support 40 has a cuboid shape. A respective one of the sides 47 of the outside surface 46 is adhered to the sole 14 of the shoe 16. In this way a respective one of the sides 47 of the outside surface 46 abuts the support surface 18. The second orthotic support 40 extends laterally across the sole 14 of the shoe 16 having the second orthotic support 40 being aligned with the arch 32 of the sole 14. In this way the second orthotic support 40 can inhibit a heel 48 of the shoe 14 from lifting upwardly from the support surface 18 thereby inhibiting the toe 34 of the shoe 14 from striking the ground when the user 20 walks. In this way the second orthotic support 40 reduces pressure on ulcers on the ball of the user's foot 36 and the user's toes 38.

A third orthotic support 50 is attachable to the sole 14 of the shoe 16 in lieu of the first orthotic support 12 and the second orthotic support 40. The third orthotic support 50 has a trapezoidal profile thereby facilitating the sole 14 of the shoe 16 to be oriented level on the ground to facilitate a user 20 with an unstable foot to walk in a level orientation. The third orthotic support 50 has a first end 52, a second end 54 and an exterior surface 56 extending between the first end 52 and the second end 54 of the third orthotic support 50. The third orthotic support 50 is elongated between the first end 52 and the second end 54 of the third orthotic support 50.

The exterior surface 56 of the third orthotic support 50 has an upper side 57 and a lower side 58. The lower side 58 slopes upwardly toward the upper side 57 between the first end 52 and the second end 54 of the third orthotic support 50. Thus, the first end 52 of the third orthotic support 50 has a greater height than the second end 54 of the third orthotic support 50. The upper side 57 is adhered to the sole 14 of the shoe 16 such that the lower side 58 abuts the support surface 18. The third orthotic support 50 extends laterally across the sole 14 of the shoe 16 having the third orthotic support 50 being aligned with the arch 32 of the sole 14. Thus, the third orthotic support 50 inhibits the heel 48 of the shoe 16 from lifting upwardly from the support surface 18 thereby inhibiting the toe 34 of the sole 14 from striking the ground when the user 20 walks. In this way the third orthotic support 50 reduces pressure on ulcers on the ball of the user's foot 36 and the user's toes 38.

The lower side 58 supports the shoe 16 at an angle when the user 20 steps in the shoe 16. In this way the third orthotic support 50 can level the shoe 16 when the user 20 walks for correcting the user 20's tendency to walk with an uneven foot. The third orthotic support 50 can be oriented to facilitate the lower side 58 to slope upwardly toward either the left side of the sole 14 or the right side of the sole 14, depending on the nature of the user's 20 physical characteristics with respect to the angle of the bottom of the user's foot 36.

In use, the first orthotic support 12 is adhered to the sole 14 of the shoe 16 with an approved adhesive that has sufficient bonding strength to ensure the first orthotic support 12 does not become dislodged due to being walked upon. In this way the first orthotic support 12 reduces the force imparted into the toe 34 of the shoe 16 when the user 20 walks by acting as a fulcrum. Thus, ulcers on the ball of the user's foot 36 or ulcers on the toe 34 of the user's foot 36 are exposed to a minimum degree of pressure to facilitate the ulcers to heal. The second orthotic support 40 is adhered to the sole 14 of the shoe 16 in lieu of the first orthotic support 12 to inhibit the toe 34 of the shoe 16 from striking the support surface 18 when the user 20 walks. In this way the ulcers on the ball of the user's foot 36 and the toe 34 of the user's foot 36 are exposed to no pressure when the user 20 walks to facilitate the ulcers to heal. The third orthotic support 50 is adhered to the sole 14 of the shoe 16 in lieu of the first orthotic support 12 and the second orthotic support 40 to not only inhibit the toe 34 of the shoe 16 from striking the support surface 18 but to also correct the user 20's unstable foot orientation. In this way the ulcers on the ball of the user's foot 36 and the toe 34 of the user's foot 36 are exposed to no pressure when the user 20 walks and the user's foot 36 is oriented in a level orientation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An orthotic support assembly for mounting on a sole of a shoe thereby inhibiting a selected area of a user's foot from being exposed to pressure for facilitating ulcers to heal, said assembly comprising:

a first orthotic support being attachable to a sole of a shoe wherein said first orthotic support is configured to abut a support surface upon which a user is walking, said first orthotic support having a rounded profile thereby facilitating the sole of the shoe to roll on said first orthotic support when the user walks;

a second orthotic support being attachable to the sole of the shoe in lieu of said first orthotic support, said second orthotic support having a rectilinear profile thereby inhibiting the sole of the shoe from rocking on said first orthotic support when the user walks; and a third orthotic support being attachable to the sole of the shoe in lieu of said second orthotic support and said third orthotic support, said third orthotic support having a trapezoidal profile thereby facilitating the sole of the shoe to be oriented level on the ground wherein said third orthotic support is configured to facilitate a user with an unstable foot to walk in a level orientation.

2. The assembly according to claim 1, wherein said first orthotic support having a first end, a second end and an outer surface extending between said first end and said second end, said first orthotic support being elongated between said first end and said second end, said outer surface having a top side and a bottom side, said top side being planar, said bottom side being concavely arcuate with respect to said top side, said top side being adhered to the sole of the shoe wherein said bottom side is configured to roll along the support surface.

3. The assembly according to claim 2, wherein said first orthotic support extends laterally across the sole of the shoe having said first orthotic support being aligned with an arch of the sole wherein said first orthotic support is configured to inhibit a toe of the shoe from striking the ground when the user walks thereby reducing pressure on ulcers on the ball of the user's foot and the user' toes.

4. The assembly according to claim 1, wherein said second orthotic support has a first end, a second end and an outside surface extending between said first end and said second end of said second orthotic support, said second orthotic support being elongated between said first end and said second end of said second orthotic support, said outside surface having a plurality of sides each intersecting a perpendicular angle, a respective one of said sides of said outside surface being adhered to the sole of the shoe wherein a respective one of said sides of said outside surface is configured to abut the support surface.

5. The assembly according to claim 4, wherein said second orthotic support extends laterally across the sole of the shoe having said second orthotic support being aligned with said arch of the sole wherein said second orthotic support is configured to inhibit a heel of the shoe from lifting upwardly from the support surface thereby inhibiting a toe of the sole from striking the ground when the user walks thereby reducing pressure on ulcers on the ball of the user's foot and the user's toes.

6. The assembly according to claim 1, wherein said third orthotic support has a first end, a second end and an exterior surface extending between said first end and said second end of said third orthotic support, said third orthotic support being elongated between said first end and said second end of said third orthotic support, said exterior surface of said third orthotic support having an upper side and a lower side, said lower side sloping upwardly toward said upper side between said first end and said second end of said third orthotic support such that said first end of said third orthotic support has a greater height than said second end of said third orthotic support, said upper side being adhered to the sole of the shoe wherein said lower side is configured to abut the support surface.

7. The assembly according to claim 6, wherein said third orthotic support extends laterally across the sole of the shoe having said third orthotic support being aligned with said arch of the sole wherein said third orthotic support is configured to inhibit a heel of the shoe from lifting upwardly from the support surface thereby inhibiting a toe of the sole from striking the ground when the user walks thereby reducing pressure on ulcers on the ball of the user's foot and the user's toes.

8. The assembly according to claim 6, wherein said lower side supports the shoe at an angle when the user steps in the shoe wherein said third orthotic support is configured to level the shoe when the user walks for correcting the user's tendency to walk with an uneven foot.

9. An orthotic support assembly for mounting on a sole of a shoe thereby inhibiting a selected area of a user's foot from being exposed to pressure for facilitating ulcers to heal, said assembly comprising:

a first orthotic support being attachable to a sole of a shoe wherein said first orthotic support is configured to abut a support surface upon which a user is walking, said first orthotic support having a rounded profile thereby facilitating the sole of the shoe to roll on said first orthotic support when the user walks, said first orthotic support having a first end, a second end and an outer surface extending between said first end and said second end, said first orthotic support being elongated between said first end and said second end, said outer surface having a top side and a bottom side, said top side being planar, said bottom side being concavely arcuate with respect to said top side, said top side being adhered to the sole of the shoe wherein said bottom side is configured to roll along the support surface, said first orthotic support extending laterally across the sole of the shoe having said first orthotic support being aligned with an arch of the sole wherein said first orthotic support is configured to inhibit a toe of the shoe from striking the ground when the user walks thereby reducing pressure on ulcers on the ball of the user's foot and the user' toes;

a second orthotic support being attachable to the sole of the shoe in lieu of said first orthotic support, said second orthotic support having a rectilinear profile thereby inhibiting the sole of the shoe from rocking on said first orthotic support when the user walks, said second orthotic support having a first end, a second end and an outside surface extending between said first end and said second end of said second orthotic support, said second orthotic support being elongated between said first end and said second end of said second orthotic support, said outside surface having a plurality of sides each intersecting a perpendicular angle, a respective one of said sides of said outside surface being adhered to the sole of the shoe wherein a respective one of said sides of said outside surface is configured to abut the support surface, said second orthotic support extending laterally across the sole of the shoe having said second orthotic support being aligned with said arch of the sole wherein said second orthotic support is configured to inhibit a heel of the shoe from lifting upwardly from the support surface thereby inhibiting a toe of the sole from striking the ground when the user walks thereby reducing pressure on ulcers on the ball of the user's foot and the user's toes; and a third orthotic support being attachable to the sole of the shoe in lieu of said first orthotic support and said second orthotic support, said third orthotic support having a trapezoidal profile thereby facilitating the sole of the shoe to be oriented level on the ground wherein said third orthotic support is configured to facilitate a user with an unstable foot to walk in a level orientation, said third orthotic support having a first end, a second end and an exterior surface extending between said first end and said second end of said third orthotic support, said third orthotic support being elongated between said first end and said second end of said third orthotic support, said exterior surface of said third orthotic support having an upper side and a lower side, said lower side sloping upwardly toward said upper side between said first end and said second end of said third orthotic support such that said first end of said third orthotic support has a greater height than said second end of said third orthotic support, said upper side being adhered to the sole of the shoe wherein said lower side is configured to abut the support surface, said third orthotic support extending laterally across the sole of the shoe having said third orthotic support being aligned with said arch of the sole wherein said third orthotic support is configured to inhibit a heel of the shoe from lifting upwardly from the support surface thereby inhibiting a toe of the sole from striking the ground when the user walks thereby reducing pressure on ulcers on the ball of the user's foot and the user's toes, said lower side supporting the shoe at an angle when the user steps in the shoe wherein said third orthotic support is configured to level the shoe when the user walks for correcting the user's tendency to walk with an uneven foot.

* * * * *